US006900820B2

(12) United States Patent
Kataoka et al.

(10) Patent No.: US 6,900,820 B2
(45) Date of Patent: May 31, 2005

(54) DISPLAY APPARATUS FOR A COMPUTER HAVING A STORAGE MEDIUM

(75) Inventors: Rieko Kataoka, Sagamihara (JP); Hideki Ogawa, Fujisawa (JP); Yasumasa Takeda, Sagamihara (JP); Masaki Kobayashi, Tokyo (JP)

(73) Assignee: International Business Machines Corporation, Armonk, NY (US)

( * ) Notice: Subject to any disclaimer, the term of this patent is extended or adjusted under 35 U.S.C. 154(b) by 308 days.

(21) Appl. No.: 09/682,276

(22) Filed: Aug. 13, 2001

(65) Prior Publication Data

US 2002/0021275 A1 Feb. 21, 2002

(30) Foreign Application Priority Data

Aug. 14, 2000 (JP) ..... 2000-245963

(51) Int. Cl.[7] ..... G09G 3/00

(52) U.S. Cl. ..... 345/690; 345/63; 345/77; 345/89; 345/102; 345/211; 315/86

(58) Field of Search ..... 345/63, 77, 89, 345/207, 690, 55, 78, 102, 211, 204; 348/227.1, 229.1; 315/86, 247, 248

(56) References Cited

U.S. PATENT DOCUMENTS

| | | | | | |
|---|---|---|---|---|---|
| 4,121,284 | A | * | 10/1978 | Hyatt | 364/200 |
| 5,445,899 | A | * | 8/1995 | Budzilek et al. | 428/690 |
| 6,049,324 | A | * | 4/2000 | Palalau et al. | 345/147 |
| 6,052,279 | A | * | 4/2000 | Friend et al. | 361/680 |
| 6,266,035 | B1 | * | 7/2001 | Palalau | 345/77 |
| 6,268,843 | B1 | * | 7/2001 | Arakawa | 345/102 |
| 6,337,675 | B1 | * | 1/2002 | Toffolo et al. | 345/77 |

FOREIGN PATENT DOCUMENTS

JP PUPA11-194749 8/2000 ..... G09G/3/36

* cited by examiner

*Primary Examiner*—Lun-Yi Lao
(74) *Attorney, Agent, or Firm*—McGinn & Gibb, PLLC; Derek S. Jennings

(57) ABSTRACT

The refresh rate of an LCD panel is changed as the brightness of the LCD panel changes. When the brightness of the LCD panel is decreased, the refresh rate is also decreased. In addition, whether the power source of the apparatus is AC or DC is determined based on whether an AC adapter is attached or not. When the DC power source is used, the brightness and refresh rate of the LCD panel is lowered with respect to when the AC power source is used.

18 Claims, 11 Drawing Sheets

[Figure 1]
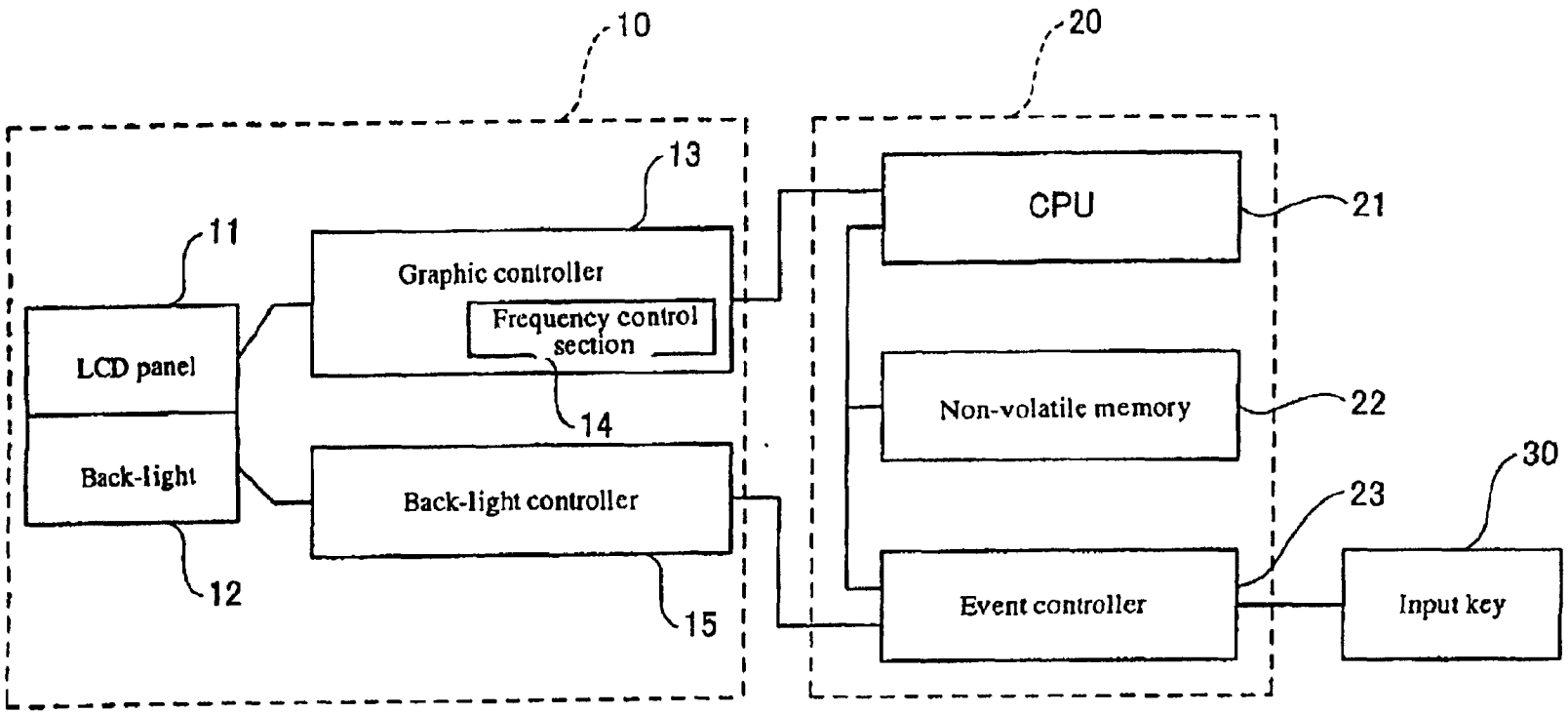

[Figure 2]

| Brightness (cd/m$^2$) | Refresh rate (Hz) |
|---|---|
| — 40 | 30 |
| 40 — 90 | 40 |
| 90 — | 60 |

T

[Figure 3]
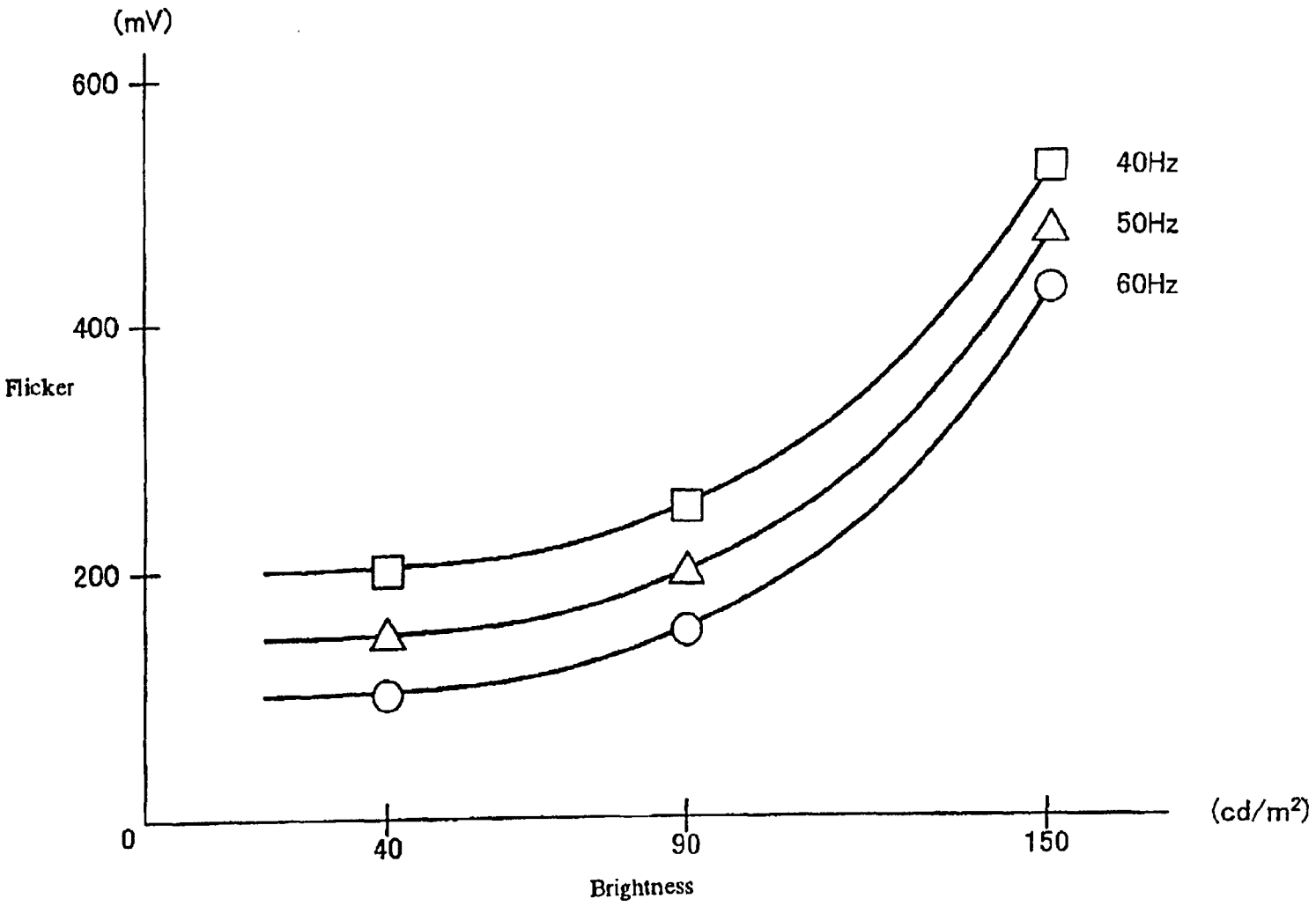

[Figure 4]
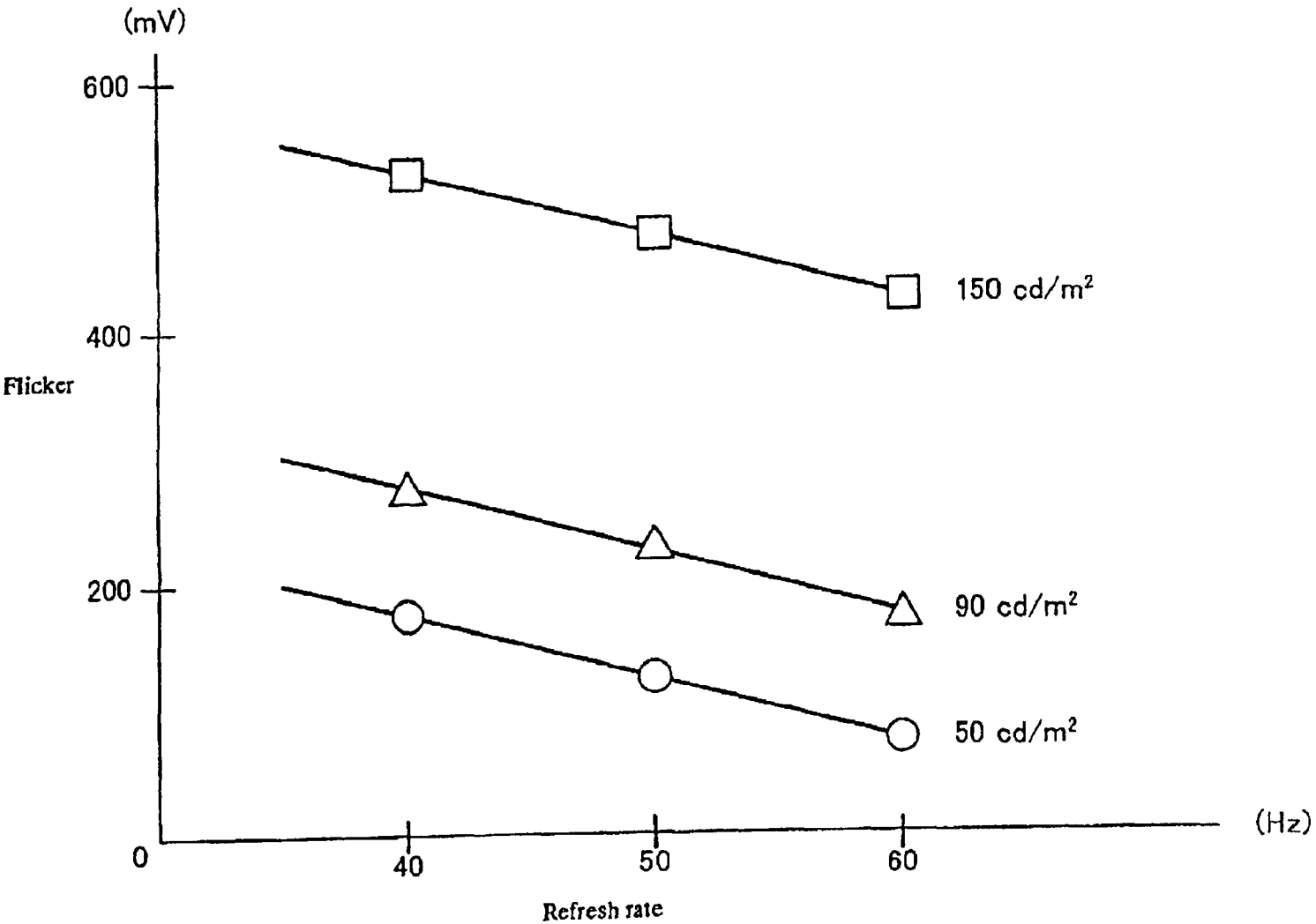

[Figure 5]
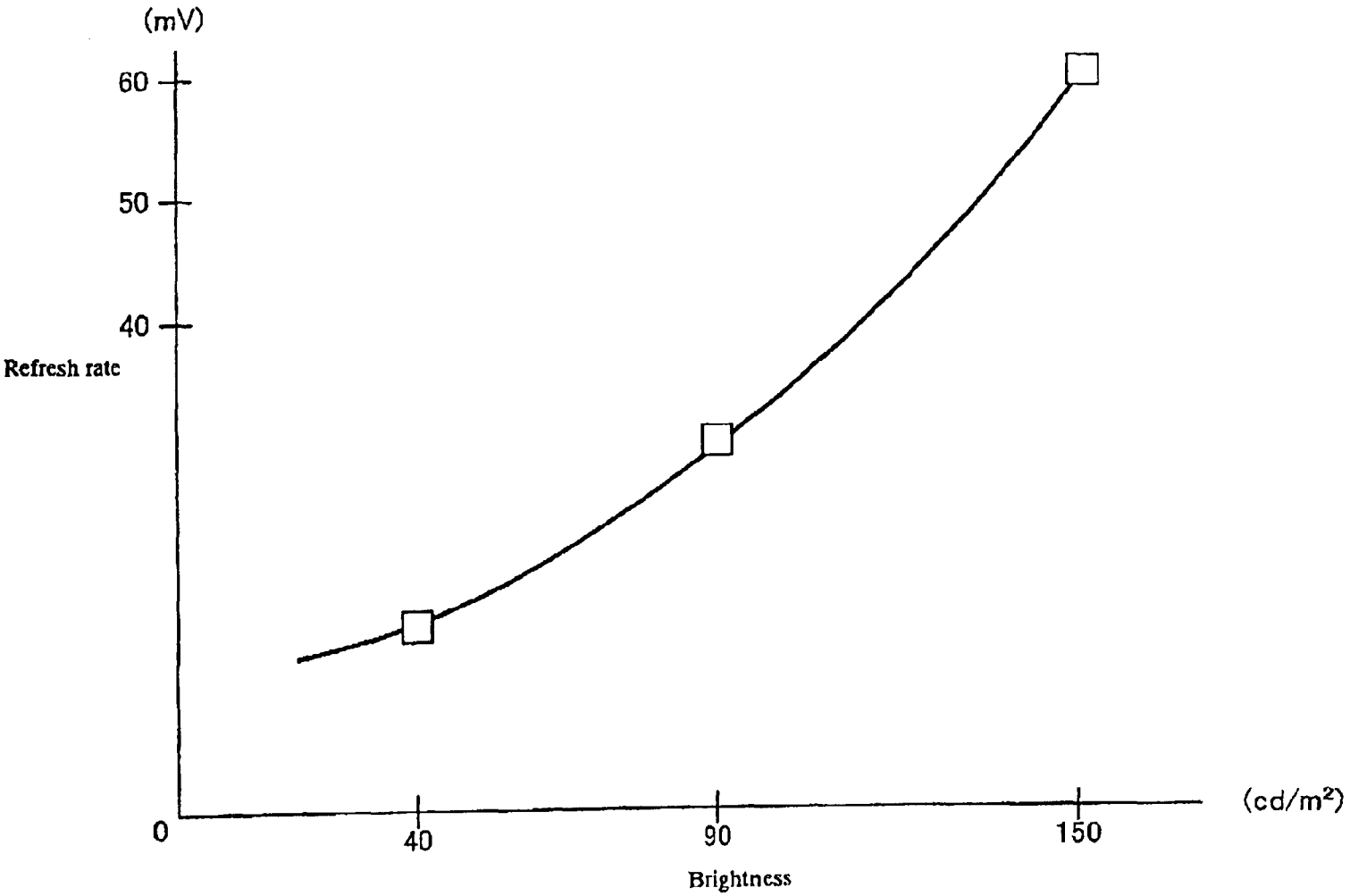

[Figure 6]
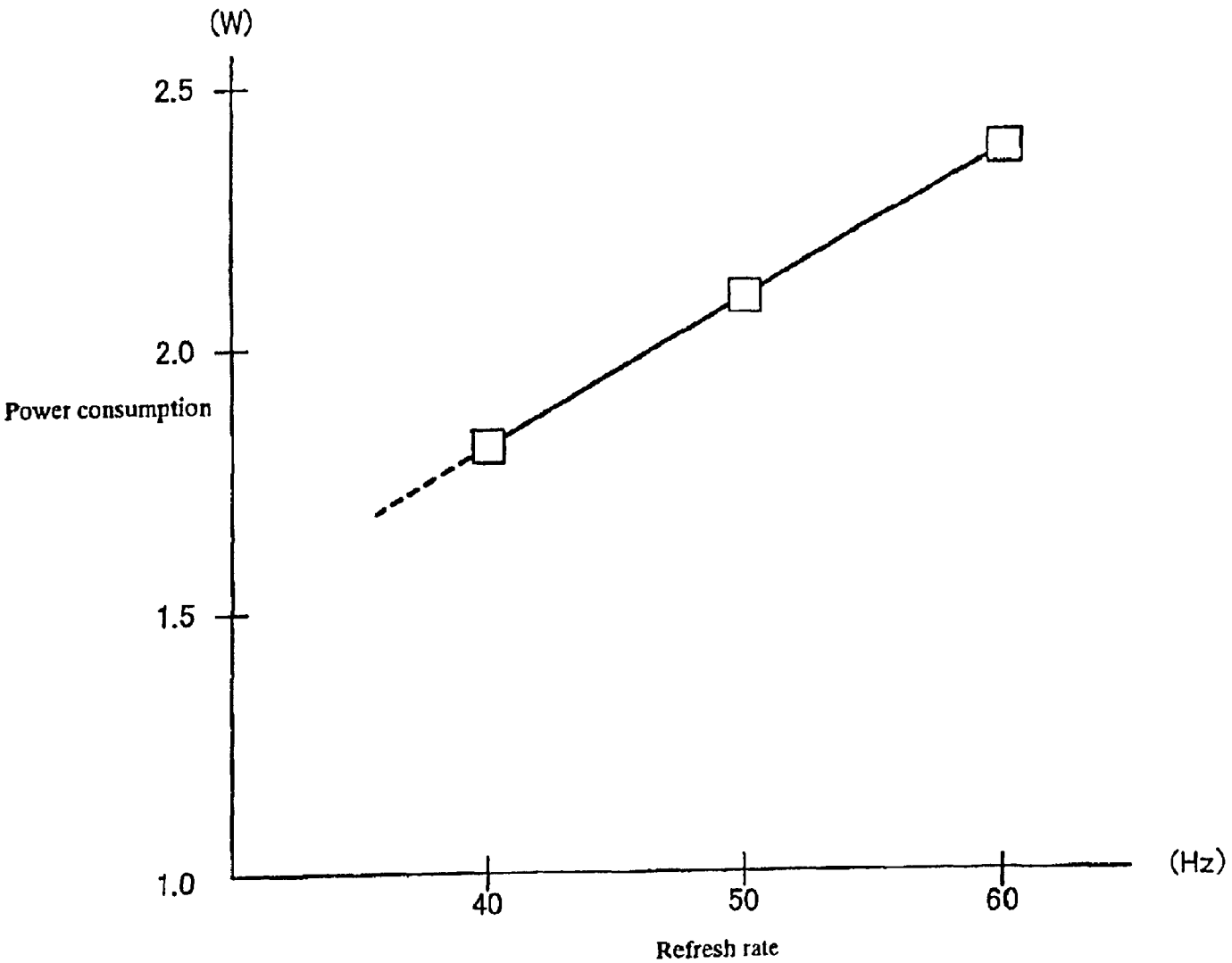

[Figure 7]
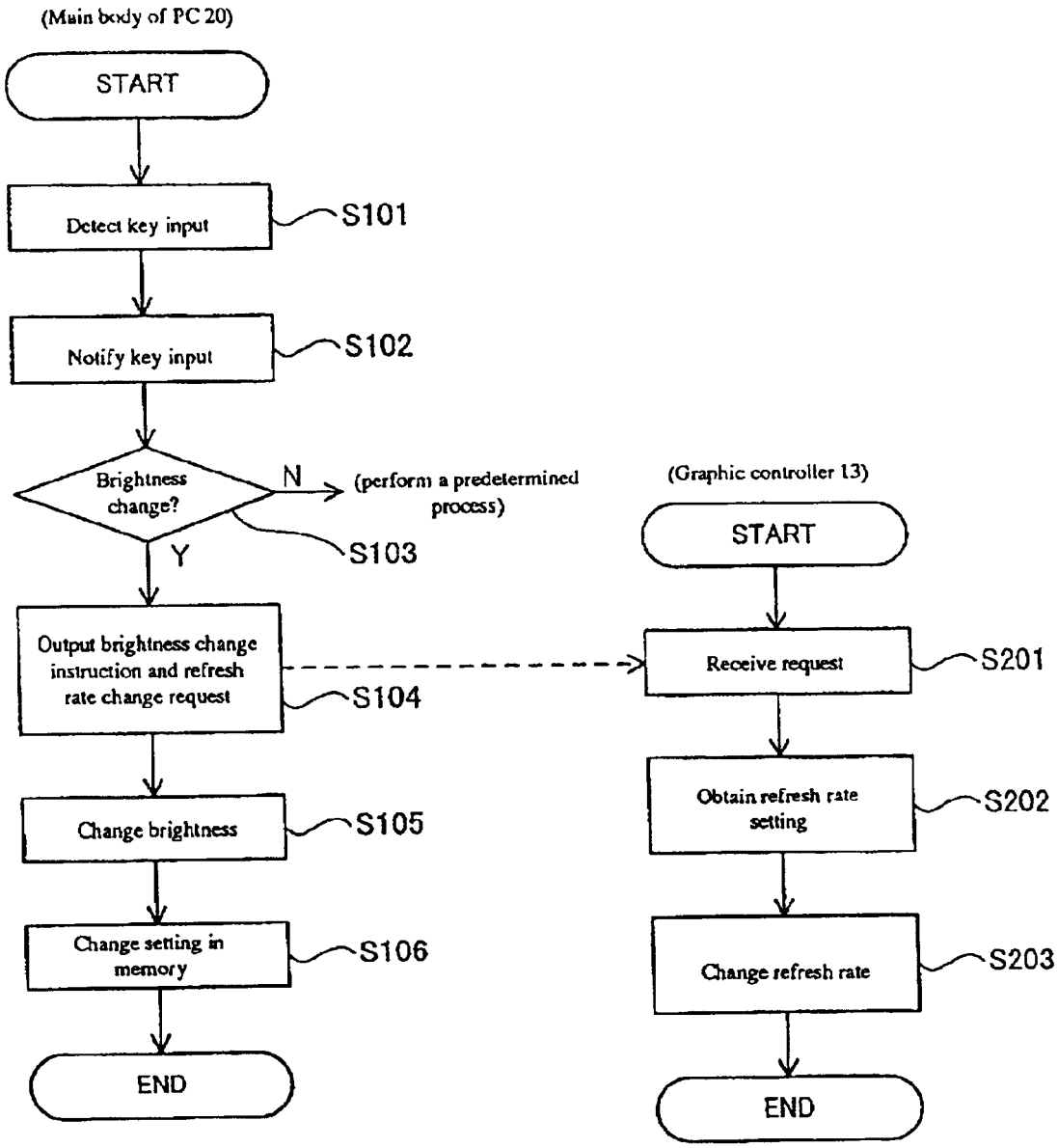

[Figure 8]
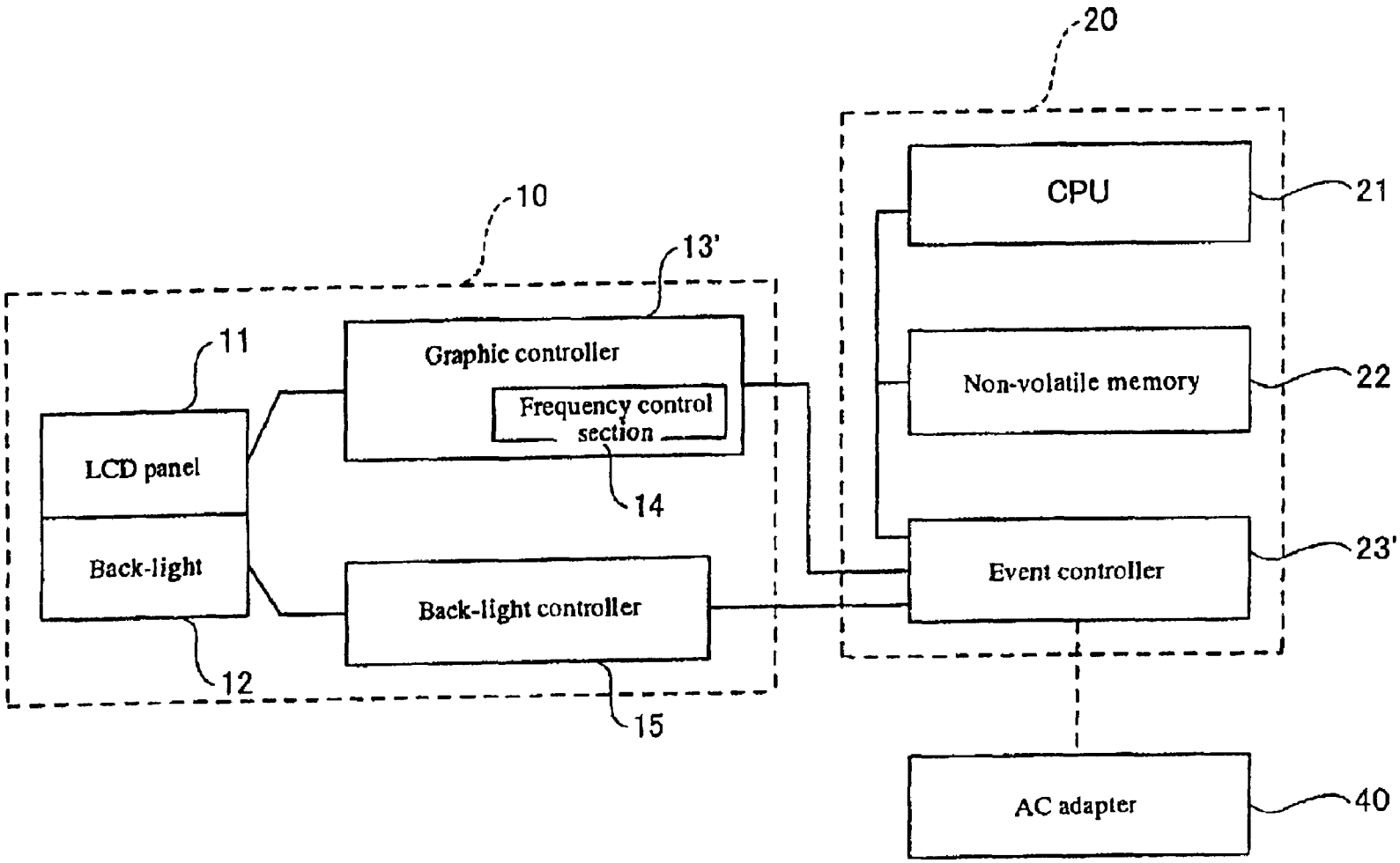

[Figure 9]
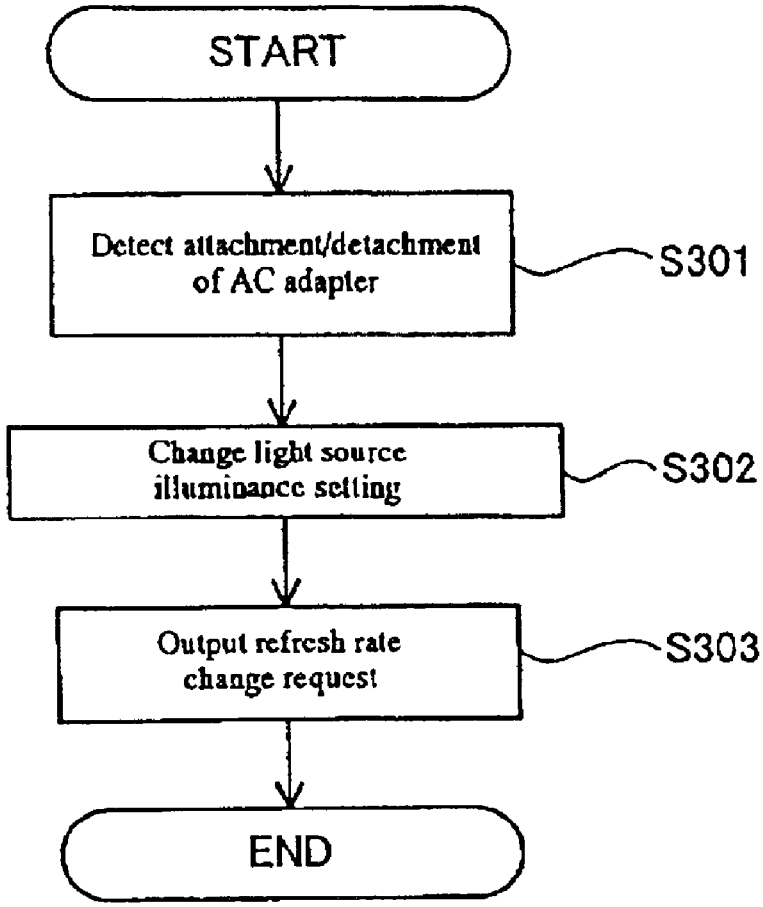

[Figure 10]
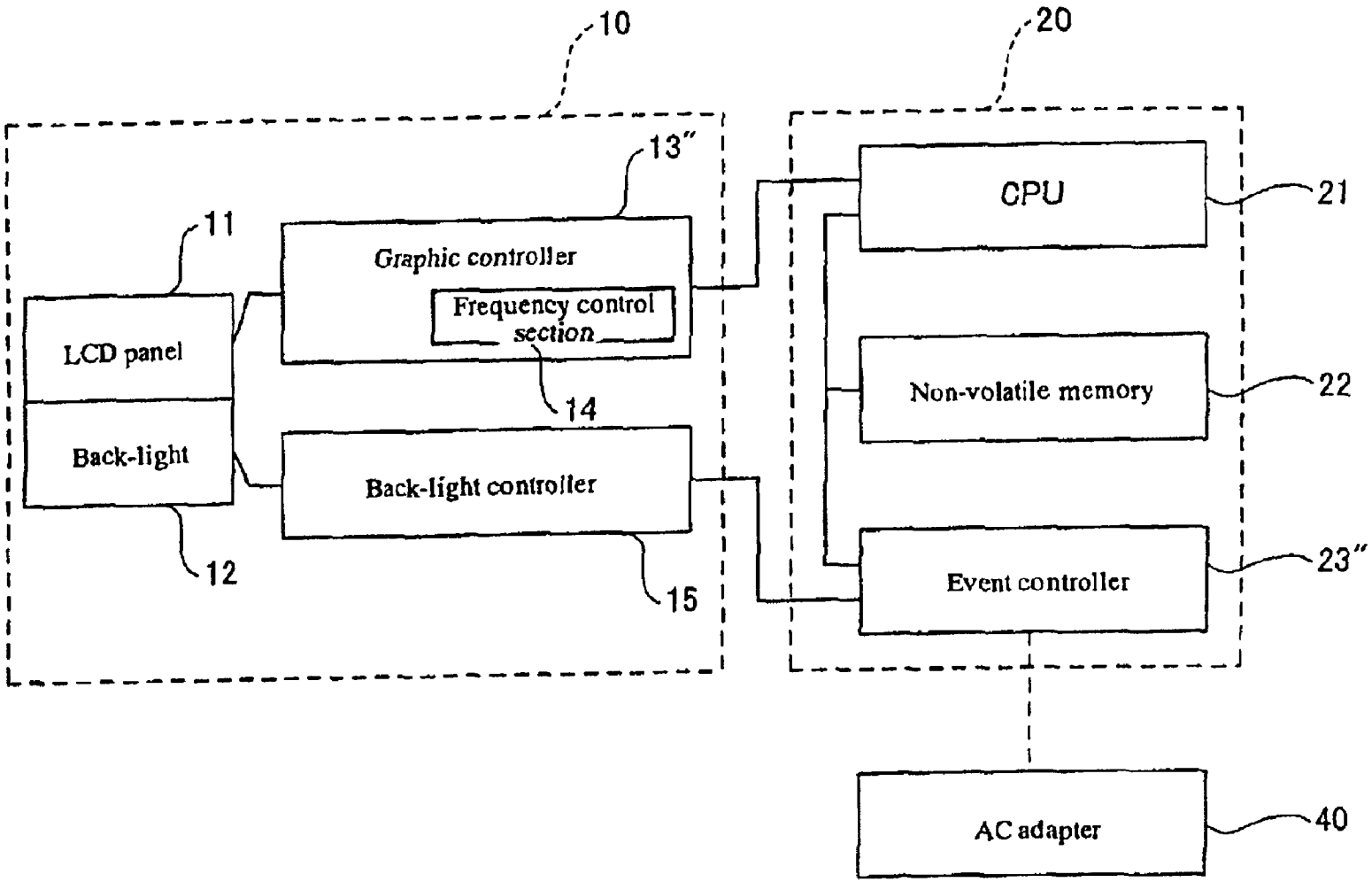

[Figure 11]
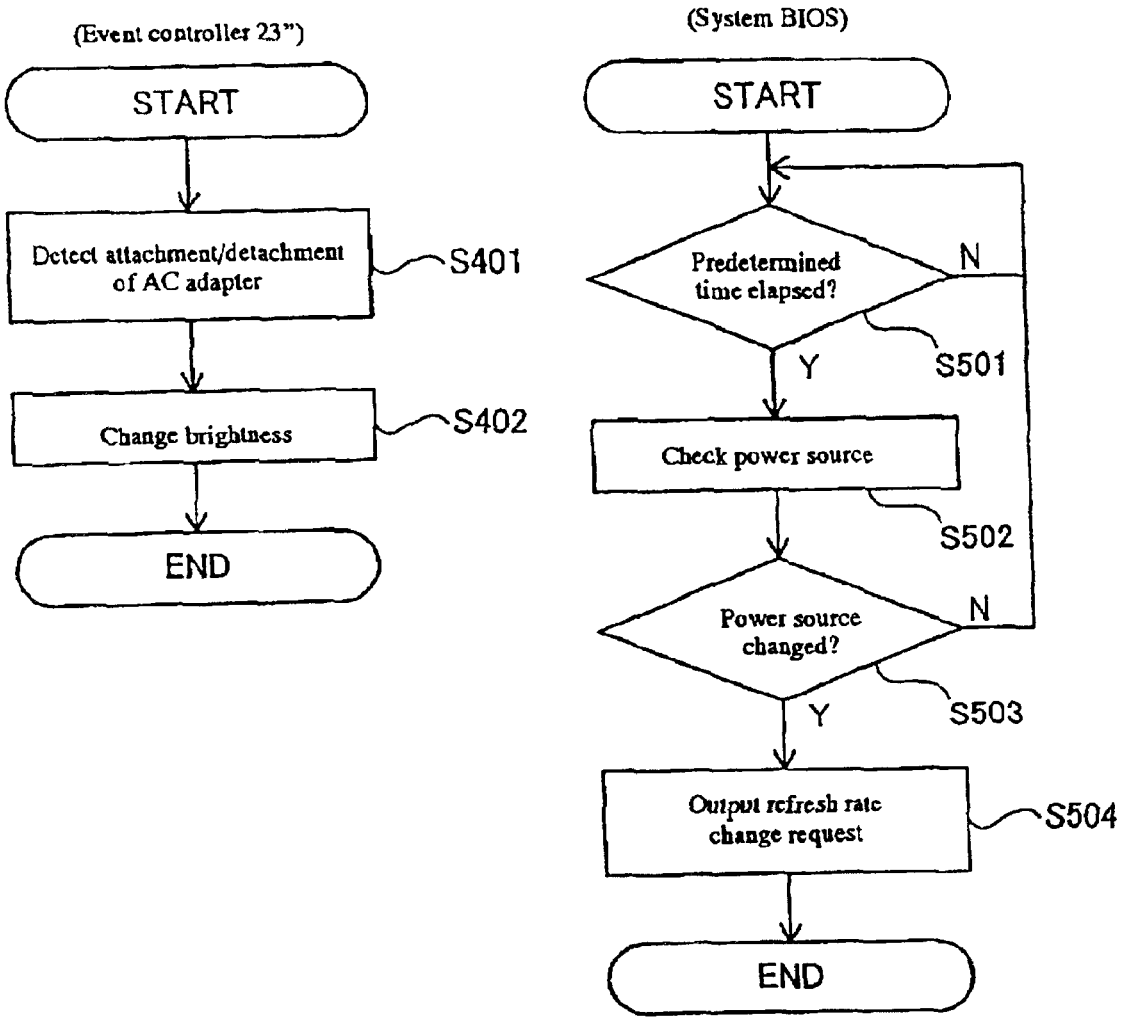

DISPLAY APPARATUS FOR A COMPUTER HAVING A STORAGE MEDIUM

BACKGROUND OF INVENTION

1. Field of the Invention

The present invention relates to a display apparatus with a display panel used for a computer apparatus, more particular to display apparatus working in conjunction with a computer apparatus and a storage medium.

2. Background Art

As a display apparatus for personal computers (PCs) and other monitors, liquid crystal displays have rapidly come into widespread use. These liquid crystal displays (LCDs) are configured to visualize an image formed on the liquid crystal surface of an LCD panel by uniformly illuminating the entire liquid crystal surface having a predetermined area with a back-light, which is a surface light source for illumination disposed behind the LCD panel.

The above-mentioned liquid crystal displays are used as a display for most notebook PCs. In notebook PC, both an alternating current (AC) power source and a direct current (DC) power source can be used. As is commonly known an AC adapter is connected to the PC to supply power from a commercial power source. To use DC power, a DC battery is attached to the PC to supply power from the battery. The technical challenge is to increase the amount of continuous operating time when using the DC power source.

To achieve this, efforts have been made to reduce power consumption in various components of a PC. In the LCD, the brightness of the LCD panel is automatically decreased when using a DC power source compared to when using an AC power source. To decrease the brightness of the LCD panel, the brightness of the back-light located behind the LCD panel is decreased. Decreasing the brightness of the LCD panel reduces power consumed by the back-light light source, thus contributing to the increase of the amount of continuous operating time by the DC battery. Still, there is a need for extending the continuous operating time when using the DC battery by further reducing power consumption.

In an intensive study to achieve the above-mentioned object, the inventors noted the refresh rate of LCD panels. To display a screen image on an LCD panel, the LCD panel is driven to redraw the screen a predetermined number of times per second. The driving frequency is called a "refresh rate (vertical operating frequency)."

Conventionally, the refresh rate has been fixed. The inventors on the other hand recognized that electric power required to drive the LCD panel could be reduced by decreasing the refresh rate.

The present invention overcomes this technical challenge and it is an object of the present invention to provide a display apparatus for a computer apparatus having a storage medium that allow power consumption to be reduced effectively.

SUMMARY OF INVENTION

A feature of the present invention includes a display apparatus having a display screen and a display controller that can change the refresh rate of the display screen according to the brightness of the display screen.

Another feature of the present invention includes a display apparatus having a display screen and a controller for changing the refresh rate when the type of power source driving the display screen is changed.

Various other objects, features, and attendant advantages of the present invention will become more fully appreciated as the same becomes better understood when considered in conjunction with the accompanying drawings, in which like reference characters designate the same or similar parts throughout the several views.

BRIEF DESCRIPTION OF DRAWINGS

FIG. 1 is a block diagram showing a configuration of a computer apparatus according to a first embodiment.

FIG. 2 shows a table associating brightness with refresh rates.

FIG. 3 shows a relation between brightness and flicker occurrence.

FIG. 4 shows a relation between refresh rates and flicker occurrence.

FIG. 5 shows the lower limit of refresh rate at which no flicker occurrence is noticeable at each brightness level.

FIG. 6 shows a relation between refresh rates and power consumption.

FIG. 7 shows a process flow for changing brightness.

FIG. 8 shows a configuration of a computer apparatus according to a second embodiment.

FIG. 9 shows a process flow for changing the refresh rate during power source switching.

FIG. 10 shows a configuration of a computer apparatus according to a third embodiment.

FIG. 11 shows a process flow for changing the refresh rate during power source switching.

DETAILED DESCRIPTION

The display controller may be characterized by the capability of changing the refresh rate to multiple levels.

The brightness of the display screen may be changed by changing the luminance of a back-light as well as by changing the gray level of a display cell with the luminance of the back-light being fixed at a constant level. Therefore a change in gray levels may be detected to change the refresh rate.

With these configurations, power consumption in the display screen can be reduced by changing, in particular, decreasing the refresh rate of the display screen.

A problem was posed during the study by the inventors that a flicker (fluctuation in a screen image) was produced by decreasing only the refresh rate. The flicker has the property of occurring infrequently when the brightness of the LCD panel is reduced.

The present invention may be viewed as a display apparatus characterized in that the refresh rate of the display panel and the luminance of the light source illuminating the display panel from behind are changed in combination with each other. Power consumption of the display panel and the light source can be reduced by ensuring that the refresh rate of the display panel decreases as the luminance of the light source decreases. In addition, when the luminance of the light source decreases, the display screen brightness of the display panel also decreases, allowing flicker of the screen to be reduced. Under such conditions, the refresh rate can be further decreased and thus power consumption can be reduced more effectively.

The refresh rate of the display panel may be set according to each level of multiple setting levels of the luminance of the light source.

The luminance of the light source may be changed by a user operation. The user can decrease the brightness of the display panel and, when this occurs, the refresh rate may be automatically decreased.

The computer apparatus according to the present invention is characterized by that the refresh rate of the display panel is changed according to whether it operates from a battery power source or a commercial power source. In particular, the computer apparatus preferably includes a power source detector for detecting the attachment/detachment of an AC adapter to the computer apparatus. Furthermore, the brightness of the display panel may be changed together with the refresh rate according to the type of power source.

The refresh rate during the use of a battery may be made lower than that during the use of an AC power source, thereby allowing continuous operating time by the battery to be extended while the computer apparatus is operating on DC battery. In addition, the brightness and the refresh rate may be changed to multiple levels while the computer apparatus is operating on DC battery. Thus the power consumption can be further reduced by decreasing the refresh rate.

The present invention may be viewed as a storage medium storing a program for causing a computer apparatus that drives a display screen to perform the steps of detecting a change in the brightness of a display panel and changing the refresh rate according to the change in the brightness of the display screen.

Furthermore, the present invention may be viewed as a storage medium storing a program for causing a computer apparatus having a display panel to perform the steps of detecting the attachment/detachment of an alternating current adapter to the computer apparatus, increasing the refresh rate of the display panel when a change from the detached state to the attached state of the AC adapter is detected, and decreasing the refresh rate of the display panel when a change from the attached state to the detached state of the AC adapter is detected.

Furthermore, the present invention may be viewed as a method for driving a display panel, characterized in that the refresh rate of the display panel is decreased to the extent that no flicker occurs in order to reduce power consumption. As used herein, "decreasing the refresh rate" means actively decreasing (changing) the refresh rate to the extent that no flicker occurs.

The present invention will be described in detail with respect to a first, second, and third embodiments shown in the attached drawings. In the embodiments described herein, examples are provided in which the present invention is applied to a notebook PC.

FIG. 1 is a diagram for explaining a general configuration of a notebook PC as a apparatus of the embodiments. In FIG. 1, reference number 10 indicates a liquid crystal display apparatus (display apparatus) and reference number 20 indicates the main unit of a personal computer.

The liquid crystal display apparatus 10 comprises a liquid crystal display (LCD) panel (display panel) 11 in which Thin Film Transistors (TFTs) having signal lines, gate lines, and deposited layers such as an amorphous silicon layer and a color filter are laminated and a liquid crystal material is contained between two glass substrates to form a display screen, and a back-light 12 provided behind the LCD panel 11 as a surface light source for emitting light for illuminating the LCD panel 11.

The LCD panel 11 includes a graphic controller (display controller) 13 as driving means for controlling a screen image to be displayed. The graphic controller 13 includes a frequency control section 14 for controlling the refresh rate of the LCD panel 11. The back-light 12 has a back-light controller 15 for controlling the luminance of the back-light.

The main unit 20 of the PC comprises, as components for controlling the display on the liquid crystal display apparatus 10, a central processing unit (CPU) 21, non-volatile memory 22 storing a predetermined data, and an event controller 23 for monitoring events input from devices connected to the main unit 20 of the PC and outputting events to each devices. The main unit 20 of the PC has input keys 30 as a device for performing predetermined operations such as the brightness adjustment of the liquid crystal display apparatus 10.

In the liquid crystal display apparatus 10 configured in this way, a screen image is displayed on the LCD panel 11 based on data transferred over a signal line, which is not shown, from the main unit 20 of the PC by the graphic controller 13. The LCD panel 11 is driven at a predetermined refresh rate by the frequency control section 14 of the graphic controller 13 to redraw the display screen a predetermined number of times per second. The brightness of the LCD panel 11 is set by controlling the light source luminance of the back light 12 with the back light controller 15.

The settings of the refresh rate and brightness of the LCD panel 11 are stored in nonvolatile memory 22. The refresh rate and brightness of the LCD panel 11 are set by referencing the settings stored in the non-volatile memory 22 during the activation of the PC.

According to an embodiment, the brightness of the surface of LCD panel 11 can be set at any level by the user performing a predetermined operation on the input keys 30. Multiple levels of the brightness of the surface of the LCD panel 11 (the corresponding light source luminance of the back-light 12) are pre-set in a system Basic Input/Output System (BIOS) of the main unit 20 of the PC. The brightness setting of the LCD panel 11 in the system BIOS, that is, the light source luminance setting of the back-light 12, increments or decrements by one level each time a predetermined operation is performed on the input keys 30, for example.

Furthermore, the setting value of the refresh rate of the LCD panel 11 changes as the brightness setting of the LCD panel 11 changes. Provided in the system BIOS is table T storing settings of the refresh rate corresponding to the brightness levels of the LCD panel 11 as shown in FIG. 2. The setting values of the refresh rate in table T are set so as to decrement as the brightness of the LCD panel 11 decrements. When the setting of the brightness of the LCD panel 11 is changed, the refresh rate is changed to a setting value corresponding to the changed brightness setting by referencing table T.

FIG. 3 shows the relation between the brightness and flicker occurrence at multiple levels of the refresh rate (for example, 40, 50, and 60 Hz) on the LCD panel 11. Because flicker is a sensory value, it is indicated in terms of voltage. As shown in the figure, the higher the brightness, the more noticeable the flicker, provided that the refresh rate is the same.

FIG. 4 shows a relation between the refresh rate and flicker occurrence at multiple levels of brightness (for example, 50, 90, and 150 cd/m2). As shown in the figure, the higher the refresh rate, the infrequently the flicker occurs, provided that the brightness is the same.

FIG. 5 shows the lower limit of the refresh rate at which flicker occurrence is not noticeable (not visible) on the LCD panel 11 at each brightness level, based on the relations shown in FIGS. 3 and 4. Table T shown in FIG. 2 is provided based on FIG. 5 and the setting values in FIG. 2 are set so as to be above the lower limit of the refresh rate shown in FIG. 5. Although the lower limit of the refresh rate at a brightness level of 40 cd/m2 is around 20 Hz in FIG. 5, the setting of the refresh rate in table T in FIG. 2 is set at 30 Hz for practical reasons concerning the LCD panel 11 (for example, when a movie on a DVD is played back, the refresh rate must be 25 Hz or higher because the number of frames per second is approximately 25).

FIG. 6 shows a relation between each refresh rate and power consumption when the refresh rate is changed to multiple levels. As shown in this figure, the lower the refresh rate, the little the power consumption.

FIG. 7 shows a process flow for changing the brightness of the liquid crystal display apparatus 10 as described above.

First, when the event controller 23 detects an input operation of the input keys 30 by the user (step S101), the event controller 23 notifies the CPU 21 of the input (step S102).

The CPU 21 checks the operation (event) performed through the input keys 30 (step S103), and if the operation is for changing the brightness, it outputs an brightness change instruction to the event controller 23 (step S104). The event controller 23 receives the instruction, references the current brightness setting stored in the non-volatile memory 22, and provides to the back-light controller 15 a brightness setting (light source luminance setting for the back-light 12) set in the system BIOS that is one level higher or lower than the current setting (depending on the operation performed on the input keys 30). The back-light controller 15 changes the light source luminance of the back-light 12 based on the provided brightness setting, thereby changing the brightness of the surface of the LCD panel 11 (step S105).

Then the brightness setting value stored in the non-volatile memory 22 in the main unit 20 of the PC is changed to a value equal to the changed brightness setting value of the LCD panel 11 (step S106).

At step 104 mentioned above, at the same time the brightness change instruction is output, the CPU 21 provides a refresh rate change request to the graphic controller 13.

The graphic controller 13 receives the refresh rate change request (step S201) and references table T shown in FIG. 2 provided in the system BIOS in the main unit 20 of the PC from a video BIOS in the graphic controller 13 to obtain a setting value of the refresh rate corresponding to the changed brightness setting value (step S202).

The graphic controller 13, which obtained the refresh rate setting value, changes the refresh rate of the LCD panel 11 based on the setting value (step S203).

The operation for changing the brightness of the LCD panel 11 is performed through the input keys 30 in this way, resulting in the change of the brightness of the LCD panel 11, and the refresh rate as well.

With the configuration in which the refresh rate can be changed as the brightness of the LCD panel 11 is changed as described above, the refresh rate automatically decreases when the brightness of the LCD panel 11 is decreased, allowing the power consumption of the LCD panel 11 to be reduced. In addition, a decrease in the brightness of the LCD panel 11 means a decrease in the light source luminance of the back-light 12, thus contributing to reduction in power consumption of the liquid crystal display apparatus 10 as a whole. Furthermore, decreasing the refresh rate reduces the number of redraws of the display image per unit of time by the graphic controller 13, thereby allowing power consumption of the graphic controller 13 to be reduced. When this notebook PC operates from a DC power source, continuous operating time by the DC battery can be extended by thus reducing power consumption in the liquid crystal display apparatus 10 and the entire notebook PC. In particular, if the LCD panel 11 that is driven at a refresh rate of 60 Hz is driven at 40 Hz, power consumption can be reduced by about 0.5 W as shown in FIG. 6. If the continuous operating time of its DC battery is 10 minutes at a refresh rate of 60 Hz, for example, the continuous operating time can be extended to about 25 minutes by decreasing the refresh rate to 40 Hz.

An example in which the refresh rate of a LCD panel 11 is changed according to the type of power source (commercial power source (AC)/battery (DC)) used in a notebook PC will be described below. In the following description of a second embodiment, elements like those in the first embodiment will be labeled with like reference numbers, the description of which will be omitted.

FIG. 8 is a diagram for explaining a general configuration of the notebook PC according to an embodiment. A difference of the notebook PC shown in FIG. 8 from the notebook PC of the first embodiment shown in FIG. 1 is that the event controller 23 in FIG. 1 controls the back-light controller 15, whereas a event controller 23' in FIG. 8 controls not only a back-light controller 15 but also a graphic controller 13'. Accordingly the event controller 23' and the graphic controller 13' are electrically interconnected in order to transmit a control signal.

In addition, the event controller 23' also acts as a power source detector and control means to find out whether an AC adapter (alternating current power supply adapter) 40 is attached or not to the main unit 20 of the PC. The event controller 23' automatically changes the light source luminance setting in the back-light controller 15 and outputs a refresh rate change request to the graphic controller 13' when the AC adapter 40 is attached to or detached from the main unit 20 of the PC.

The graphic controller 13', which receives the output, contains refresh rate settings which vary according to whether an AC adapter 40 is attached to the PC or not. In particular, when the AC adapter 40 is not attached, that is, when power is supplied form a DC battery, the refresh rate is set to a low setting with respect to when the AC adapter 40 is attached. For example, the refresh rate is set to 60 Hz when the AC adapter 40 is attached and set to 40 Hz when it is not attached.

FIG. 9 shows a process flow in the event controller 23' during the switching between the power sources.

When the event controller 23' detects that the AC adapter 40 is attached to or detached from the main unit 20 of the PC (step S301), the event controller 23' automatically changes setting of the light source luminance in the back-light controller 15 (step S302). Then the light source luminance of the back-light 12 changes to change the brightness of the LCD panel 11. For example, the brightness may be set to 150 cd/m2 when the AC adapter 40 is attached or may be set to 90 cd/m2 when the AC adapter 40 is not attached.

Then the event controller 23' outputs a refresh rate change request to the graphic controller 13' (step S303). The graphic controller 13 receives this request and changes the current refresh rate to a predetermined refresh rate. Thus the refresh rate of the LCD panel 11 is changed.

In this way, the brightness and refresh rate of the LCD panel 11 are changed according to whether an AC adapter 40 is attached or not, that is, whether the notebook PC is operating on AC or DC current. When the PC is operating on DC current, in particular on a DC battery, the brightness and refresh rate of the LCD panel 11 is lowered with respect to those when the PC operates on AC current, thereby allowing power consumption to be reduced to extend continuous operating time by DC battery.

A third embodiment, which is a variation of the second embodiment, will be described below. Whereas the brightness and refresh rate of the LCD panel 11 are changed by hardware, i.e. the event controller 23', in the second embodiment, the same process is performed by software in the third embodiment. In the following description, elements like those in the first and second embodiments will be labeled with like reference numbers, the description of which will be omitted.

As shown in FIG. 10, an event controller 23" in a notebook PC of this embodiment also acts as a power source detector to find out whether an AC adapter 40 is attached to the main unit 20 of the PC. When the event controller 23" detects that the AC adapter 40 is attached to or detached from the main unit 20 of the PC (step S401), a light source luminance setting in a back-light controller 15 is changed to change the brightness of an LCD panel 11 (step S402).

Determination is made at predetermined time intervals in the system BIOS of the main unit 20 of the PC as to whether the power supply mode, which is set according to the detection in the event controller 23", is AC or DC mode (steps S501, 502, 503). If a power supply mode change is detected, a refresh rate change request is provided to a graphic controller 13" (step S504).

In the graphic controller 13" which received the request, a table (not shown) provided in a system BIOS is referenced through a video BIOS and a setting value is obtained, as in the graphic controller 13 of the first embodiment. The table contains refresh rate settings which vary according to whether an AC adapter 40 is attached to the PC or not, as in the second embodiment. When the AC adapter 40 is not attached, that is, when power is supplied from a DC battery, the refresh rate is set to a low setting with respect to when the AC adapter 40 is attached. In this embodiment, the brightness is set to 150 cd/m2 and the refresh rate is set to 60 Hz when the AC adapter 40 is attached, and the brightness is set to 90 cd/m2 and the refresh rate is set to 40 Hz when it is not attached.

In this way, the brightness and refresh rate of the LCD panel 11 can be changed according to whether an AC adapter 40 is attached or not, that is, whether the notebook PC is operating on AC or DC current. In particular, when the PC is driven by a DC battery, the brightness and refresh rate of the LCD panel 11 can be lowered to allow power consumption to be reduced to extend continuous operating time by DC battery.

While in the third embodiment described above, the graphic controller 13" references the settings in the system BIOS to obtain the setting of the refresh rate, the graphic controller 13" itself contains a plurality of refresh rate settings. Also, the graphic controller 13 in the first embodiment itself may contain a plurality of refresh rate settings.

While switching between only two levels, one for AC and another for DC, is performed in the second and third embodiments, more than two levels may be provided. For example, more then one level of brightness and refresh rate settings may be provided for DC current. Of course, these settings should be lower than those for AC current. In that case, the brightness settings for DC mode may be selected by a user through an input key 30 as in the first embodiment. With this configuration, continuous operating time by DC battery can be further extended by further decreasing the brightness and the refresh rate during the use of DC battery in which the effect of reduction in power consumption is significant.

While in the first to third embodiments described above, selection is made from a plurality of settings of brightness and refresh rate, the brightness and the refresh rate may be changed continuously within a predetermined range. The brightness of the liquid crystal display apparatus 10 can be changed not only by changing the luminance of the back-light 12 but also by changing the gray levels of the display cell of the LCD panel 11. Therefore, a change in the gray levels of the display cell of the LCD panel 11 may be detected and the refresh rate may be changed based on the detected change.

While the above-described embodiments are configured to change the refresh rate together with the change of the brightness of LCD panel 11, the refresh rate by itself may be changed without changing the brightness.

Specific values for the brightness and refresh rate of the LCD panel 11 have been provided as examples and not intended to limit these values. While in the description above, the settings of the brightness are stored in non-volatile memory 22, these settings may be stored in other components such as a graphic controller 13.

The present invention is not limited to a liquid crystal display 10 for notebook PCs, rather, the present invention may be equally applied to other devices such as LCD monitors.

In addition, the display apparatus and display panel which form the display of the present invention are not limited to those that drive liquid crystal. Instead, the present invention may be equally applied to any displays that redraw the display image on it at a given fresh rate, including monitors, display apparatus and display panels of Cathode Ray Tube (CRT) type, for example.

The present invention may be implemented as a recording medium, such as CD-ROM, a DVD, memory, or a hard disk, containing a program for performing the process described above with respect to the above-described embodiments, and may cause a computer apparatus having a display panel and driving means for driving the display panel to execute that program.

Furthermore, the present invention may be implemented as a communication apparatus comprising storage means, such as CD-ROM, a DVD, memory, a hard disk, for storing the above-mentioned program, and transmission medium for transmitting the program over a network such as the Internet and a LAN to an apparatus, which reads the program from the storage medium and executes the program.

As described above, according to the present invention, power consumption in the apparatus can be effectively reduced and continuous operating time of the apparatus during operating on DC battery can be extended with flicker occurrences being minimized.

In addition to the above-mentioned variations, any other configuration may be used without departing from the spirit of the present invention.

It is to be understood that the present invention is not limited to the embodiments described above, but encompasses any and all embodiments within the scope of the following claims:

What is claimed is:

1. A display apparatus comprising:

a display screen;

a display controller for being able to change a refresh rate of said display screen according to a brightness of said display screen;

a power source detector connected to said display controller, said power source detector being adapted to detect whether said display apparatus is being powered by an alternating current power source or a direct current power source such that said refresh rate of said display screen is lower when said direct current power source is providing power to said display apparatus compared to when said alternating current power source is providing power to said display apparatus; and wherein the brightness of said display screen is set to a plurality of levels and the refresh rate of said display screen is set to correspond to each level of the brightness of said display screen.

2. The display apparatus according to claim 1, wherein said display controller can change the refresh rate to a plurality of levels.

3. The display apparatus according to claim 1, wherein said display controller changes the refresh rate when a predetermined condition is met.

4. The display apparatus of claim 1, wherein the refresh rate of said display screen decreases as the brightness of said display screen decreases.

5. The display apparatus of claim 4, wherein when the brightness of said display screen decreases, fluctuations in a screen image on said display screen is reduced.

6. The display apparatus of claim 1, wherein the brightness of said display screen can be changed by a user operation.

7. The display apparatus of claim 1, further comprising a light source for illuminating said display screen.

8. The storage medium of claim 1, wherein the brightness of said display screen can be changed by a user operation.

9. The storage medium of claim 1, further comprising a light source for illuminating said display screen.

10. A display apparatus comprising:

a display panel;

a light source for illuminating said display panel from behind; wherein, the luminance of said light source and the refresh rate of said display panel are changed in combination with each other;

a power source detector adapted to detect whether said display apparatus is being powered by an alternating current power source or a direct current power source such that said refresh rate of said display panel is lower when said direct current power source is providing power to said display apparatus compared to when said alternating current power source is providing power to said display apparatus; and wherein the luminance of said light source is set to a plurality of levels and the refresh rate of said display panel is set to correspond to each level of the luminance of said light source.

11. The display apparatus according to claim 10, wherein the refresh rate of said display panel decreases as the luminance of said light source decreases.

12. The display apparatus according to claim 10, wherein the luminance of said light source can be changed by a user operation.

13. The display apparatus of claim 10, wherein when the luminance of the light source decreases, a display screen brightness of the display panel decreases.

14. The display apparatus of claim 13, wherein when the brightness of said display screen decreases, fluctuations in a screen image on said display screen is reduced.

15. The display apparatus of claim 10, wherein said display panel is a liquid crystal display panel.

16. A storage medium storing a program to be executed by a computer driving a display screen, wherein said program can be read by said computer and said program causing said computer to perform the steps of:

detecting a change in a brightness of said display screen; and changing a refresh rate of said display screen according to the change in the brightness of said display screen;

detecting whether said computer is being powered by an alternating current power source or a direct current power source such that said refresh rate of said display screen is lower when said direct current power source is providing power to said computer compared to when said alternating current power source is providing power to said computer;

wherein the brightness of said display screen is set to a plurality of levels and the refresh rate of said display screen is set to correspond to each level of the brightness of said display screen.

17. The storage medium of claim 16, wherein the refresh rate of said display screen decreases as the brightness of said display screen decreases.

18. The storage medium of claim 17, wherein when the brightness of said display screen decreases, fluctuations in a screen image on said display screen is reduced.

* * * * *